US005860404A

United States Patent [19]

Tanaka

[11] Patent Number: 5,860,404

[45] Date of Patent: Jan. 19, 1999

[54] LUBRICATING-OIL CHANNEL STRUCTURE OF ENGINE

[75] Inventor: Ryuji Tanaka, Shizuoka-ken, Japan

[73] Assignee: Suzuki Motor Corporation, Shizuoka, Japan

[21] Appl. No.: 12,759

[22] Filed: Jan. 23, 1998

[30] Foreign Application Priority Data

Jan. 31, 1997 [JP] Japan ..... 9-032886

[51] Int. Cl.[6] ..... F01M 1/00

[52] U.S. Cl. ..... 123/196 R; 184/6.5

[58] Field of Search ..... 123/196 R; 184/6.5

[56] References Cited

U.S. PATENT DOCUMENTS 4,033,312 7/1977 Howe ..... 123/196 R

*Primary Examiner*—Erick R. Solis
*Assistant Examiner*—Hai Huynh
*Attorney, Agent, or Firm*—Flynn, Thiel, Boutell & Tanis, P.C.

[57] ABSTRACT

In an engine, an oil channel arrangement is formed between an outer periphery of a lower-case setting bolt and inner peripheries of a case-side bolt hole and a block-side bolt hole so as to prevent the flow of foreign matters as contained in lubricating oil flowing from a main gallery toward a crank journal. The oil channel has a cross section that varies between the main gallery and the crank journal so as to decrease the flow velocity of the lubricating oil flowing from the main gallery toward the crank journal. The decreased velocity of oil allows the foreign matter to settle by gravitational force in a collecting space.

10 Claims, 6 Drawing Sheets

LUBRICATING-OIL CHANNEL STRUCTURE OF ENGINE

FIELD OF THE INVENTION

The present invention relates to a lubricating-oil channel structure of an engine and, more particularly, to a lubricating-oil channel structure of an internal combustion engine capable of preventing foreign matters contained in lubricating oil from flowing into the crank journals of a rotating crankshaft.

BACKGROUND OF THE INVENTION

An engine of a vehicle supplies lubricating oil to the journals of a crankshaft in order to lubricate the crankshaft. A conventional engine block arrangement is shown in FIGS. 7 to 9 wherein an engine 102 has a lower case 108 fixed to the lower side of a cylinder block 104 by setting bolts 110 so as to rotatably support therebetween a journal 106 of a rotatable crankshaft. A block-side bolt hole 112 is formed at the lower side of the cylinder block 104. The lower part of the block-side bolt hole 112 is smoothly formed, and the upper part is formed with internal threads so as to threadably engage the upper end of the setting bolt 110. A case-side bolt hole 114 passes vertically through the lower case 108 in alignment with the block-side bolt hole 112. Therefore, the lower case 108 is fixed to the lower side of the cylinder block 104 by inserting the setting bolts 110 into the block-side bolt holes 112 through the case-side bolt holes 114. In this arrangement, the crankshaft journal 106 is rotatably supported between the block-side journal bearing surface 116 of the cylinder block 104 and the case-side journal bearing surface 118 of the lower case 108 through block-side and case-side crank bearings 120 and 122, respectively.

A main gallery 124 serving as a lubricating-oil channel for circulating oil and extends in the longitudinal direction of the engine 102 generally parallel with the axis 115 of the crankshaft (not shown).

An oil channel 128 is linearly formed in the lower case 108 and communicates the main gallery 124 with a case-side oil groove 126 opening at the upper side of the case-side crank bearing 122 along the back or outer side thereof. Therefore, one of a plurality of the oil channels 128 linearly points to each of the crank journals 106 from the main gallery 124 as shown in FIG. 9. A block-side oil groove 130 is formed at the lower side of the cylinder block 104 and communicates with each case-side oil groove 126 and extends along the back or outer side of each block-side bearing 120. A plurality of oil passing holes 132 are formed in each block-side crank bearing 120 so as to introduce the oil from the respective block-side oil groove 130 into the respective crank journal 106.

In FIGS. 7 and 9, 134 denotes a knock-pin, 136 denotes a blow-by gas channel also serving as an oil dropping channel, 138 denotes an oil-filter setting portion, and 140 denotes an oil-cooler setting portion.

However, because oil is supplied to the crank journals from the main gallery through oil channels, a problem occurs in that foreign matters such as chips and cast sand left in the main gallery flow into the crank journals and damage the crank bearings or cause seizing.

SUMMARY OF THE INVENTION

Therefore, to alleviate the above problem, the present invention relates to an improved lubricating-oil channel structure for an engine having a block-side bolt hole formed in the cylinder block, a lower case set to the cylinder block, a case-side bolt hole formed in the lower case, a lower-case setting bolt inserted into the case-side bolt hole and screwed into the block-side bolt hole so as to fix the lower case to the cylinder block, the journal of a crankshaft rotatably supported between the cylinder block and the lower case through a crank bearing, a main gallery formed in the lower case for circulating lubricating oil, and an oil channel leading the lubricating oil supplied from the main gallery to the crank journal; in which an oil channel is formed between the outer periphery of the lower-case setting bolt and the inner peripheries of the case-side bolt hole and the block-side bolt hole so as to prevent flow of foreign matters as contained in the lubricating oil fed to the crank journal from the main gallery.

Moreover, the present invention is characterized by using a lubricating-oil channel structure of an engine, as aforesaid, in which the cross section of the oil channel formed between the main gallery and the crank journal varies so as to decrease the flow velocity of the lubricating oil as it is fed from the main gallery to the crank journal.

In the present invention, foreign matters contained in the lubricating oil flowing toward the crank journal from the main oil gallery are removed by a specific-shaped oil channel acting as a filter so as to prevent the foreign matters from flowing to the journal. The foreign matters thus do not enter the crank journal, and it is possible to prevent the crank bearing from damage or seizing.

DETAILED DESCRIPTION

A preferred embodiment of the present invention is described below with referring to FIGS. 1–6 of the drawings.

Figure 6:
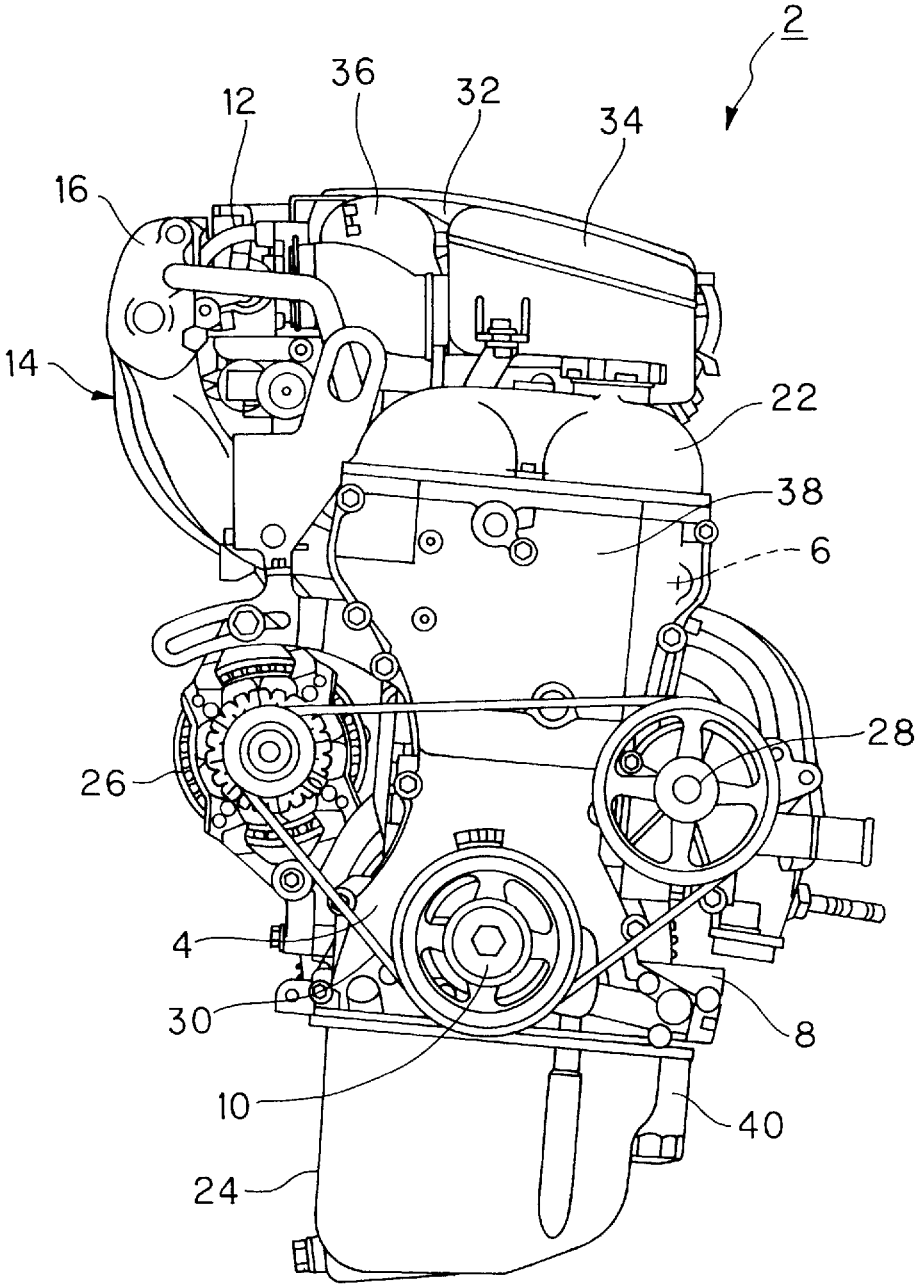
FIG. 6 is an end view of an engine.
Figure 7:
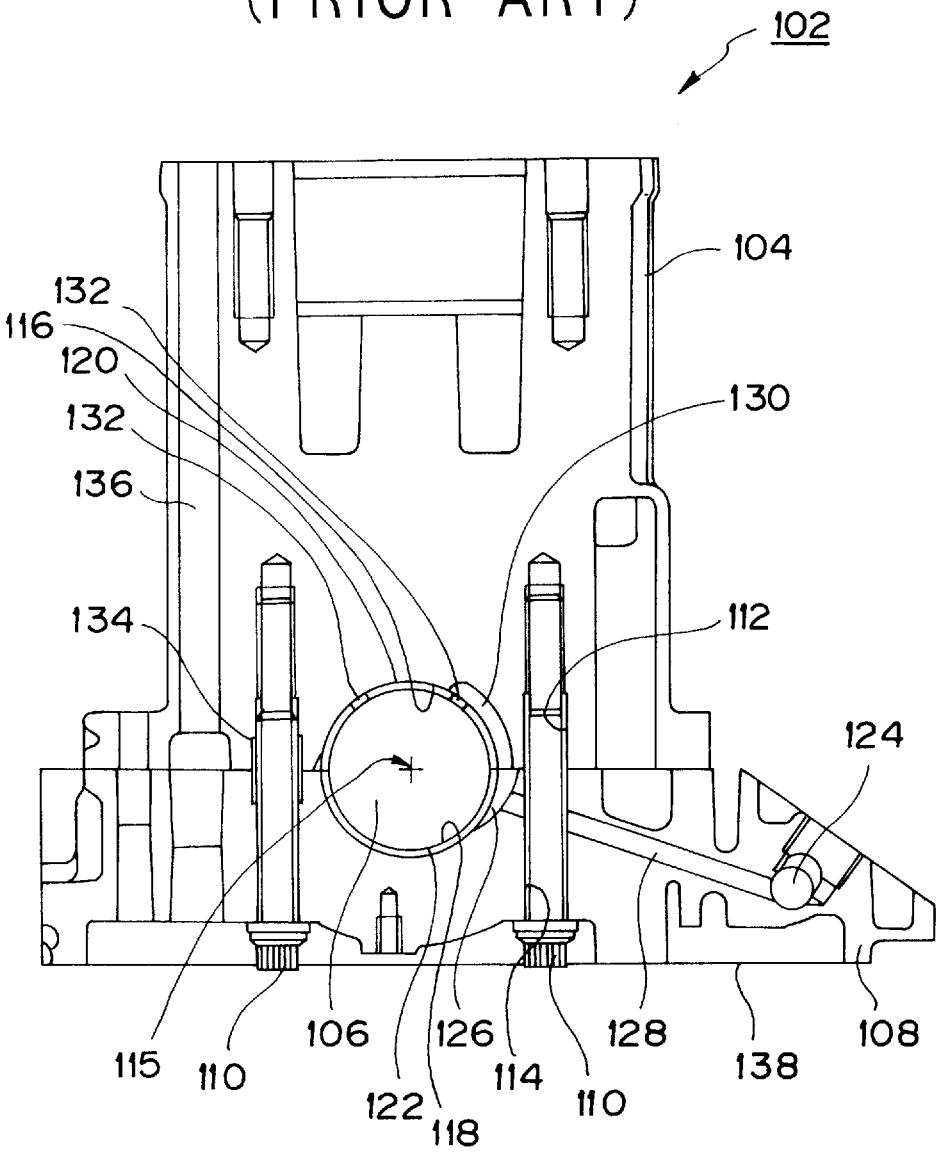
FIG. 7 (PRIOR ART)
FIG. 7 is a sectional view similar to FIG. 3 but showing a conventional engine.
Figure 8:
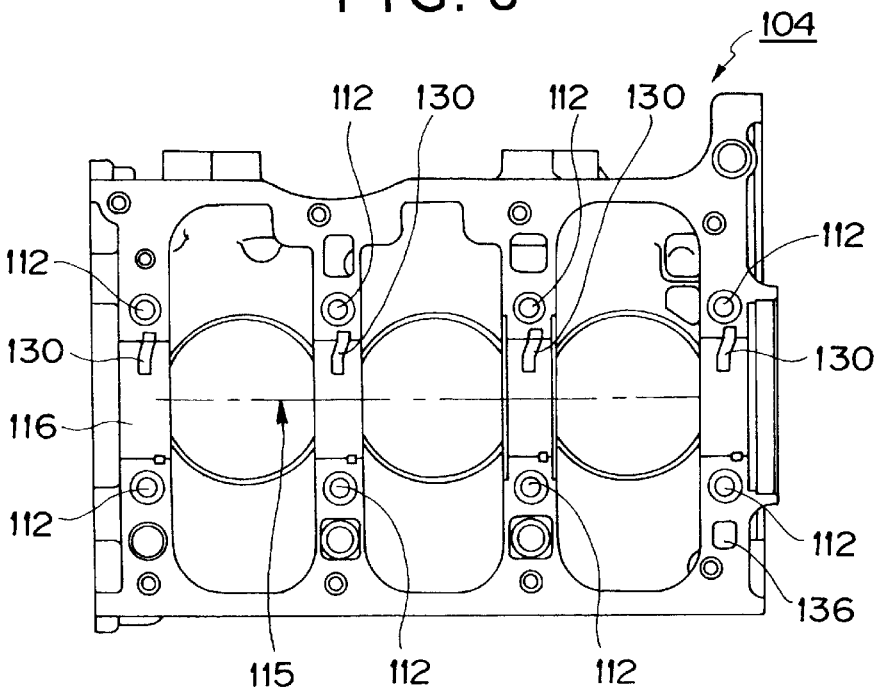
FIG. 8 is a bottom view of the cylinder block of FIG. 7.
Figure 9:
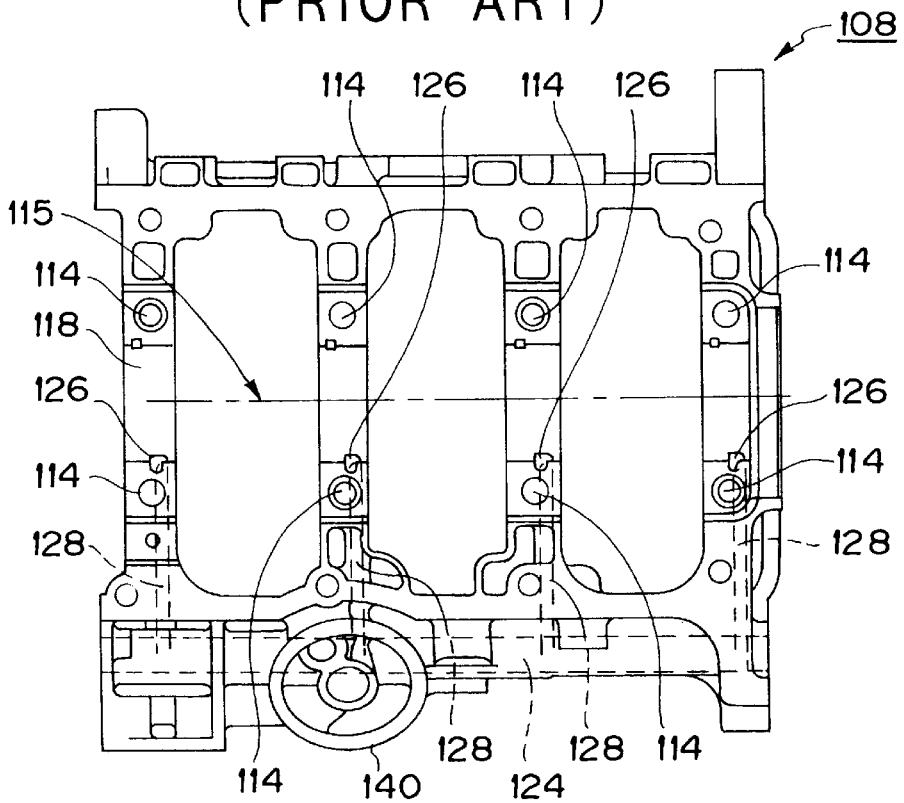
FIG. 9 (PRIOR ART)
FIG. 9 is a top view of the lower case of FIG. 7.

In FIG. 6, numeral 2 denotes an engine, 4 denotes a cylinder block, 6 denotes a cylinder head, 8 denotes a lower case, 10 denotes a crankshaft, 12 denotes a throttle body, 14 denotes an intake manifold, 16 denotes a surge tank, 22 denotes a cylinder head cover, 24 denotes an oil pan, 26 denotes a generator, 28 denotes a water pump, 30 denotes a belt, 32 denotes an air cleaner, 34 denotes a resonator, 36 denotes an intake pipe, 38 denotes a timing chain cover, and 40 denotes an oil filter.

Figure 1:
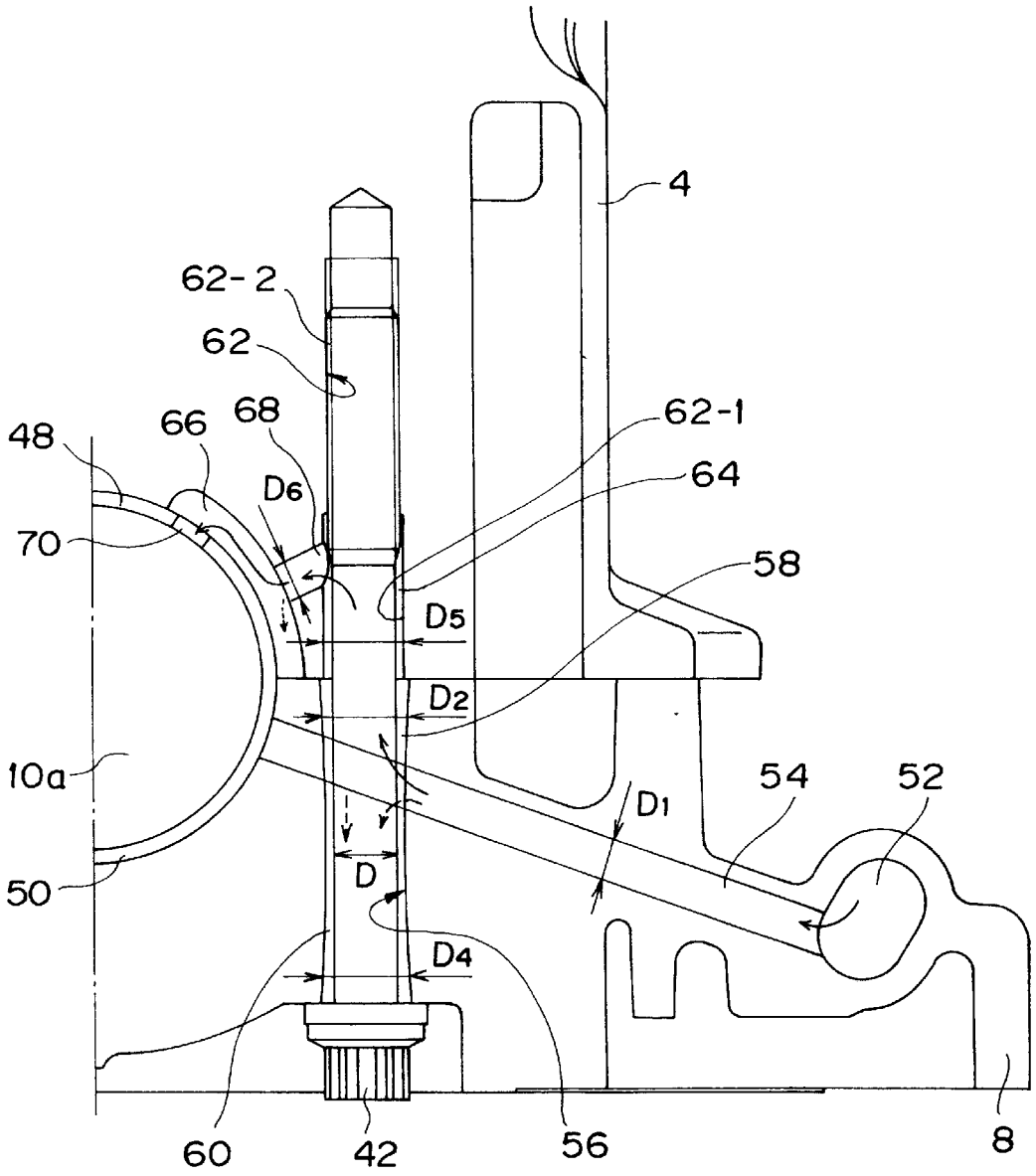
FIG. 1 is an enlarged view of a portion of the engine shown in FIG. 3.
Figure 3:
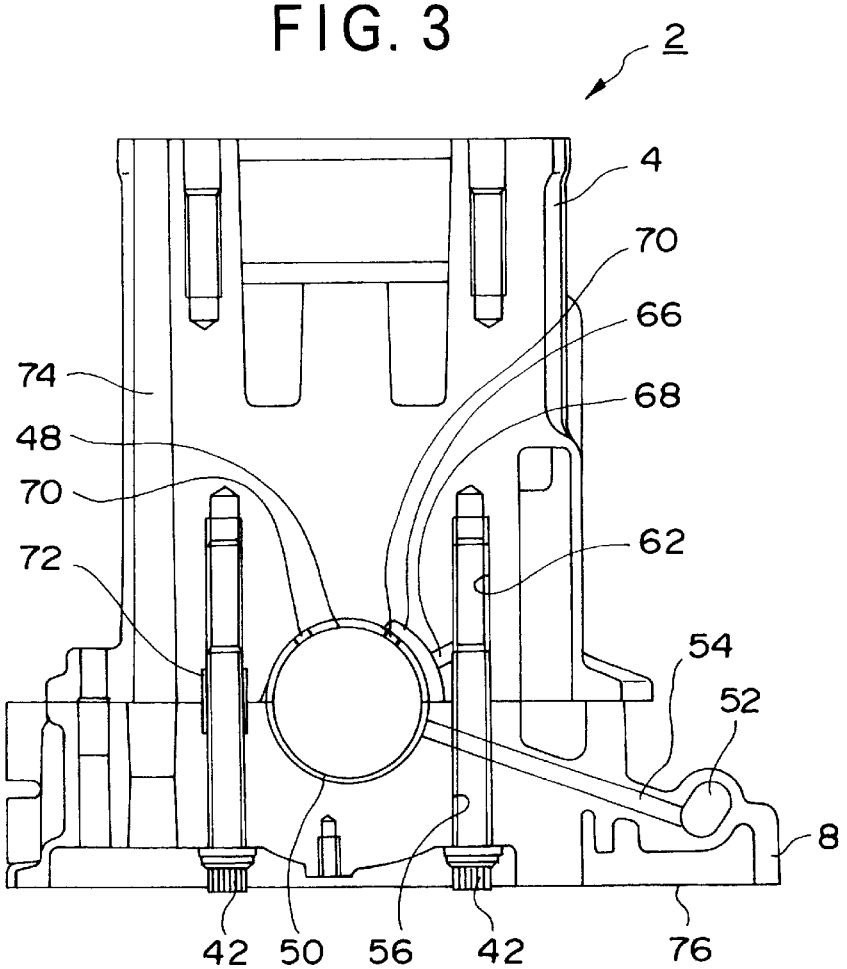
FIG. 3 is a transverse elevational view through the lower case and cylinder block assembly of an engine.

As shown in FIGS. 1 and 3, the lower case 8 is fixed to the lower side of the cylinder block 4 by a lower case setting bolt 42 having a diameter D. A journal 10*a* of the crankshaft 10 is rotatably supported between a block-side journal bearing surface 44 of the cylinder block 4 and a case-side journal bearing surface 46 of the lower case 8 through a block-side crank bearing 48 and a case-side crank bearing 50, respectively.

A main gallery 52 serving as a lubricating-oil channel for circulating oil is formed in the lower case 8 and extends in the longitudinal direction of the engine 2. A first linear case-side oil channel 54 is formed in the lower case 8 and extends between the back of the case-side crank bearing 50 and the main gallery 52. The first case-side oil channel 54 is formed with a diameter D1, and an end portion (the left end in FIG. 1) of channel 54 closed by the case-side crank bearing 50.

Figure 2:
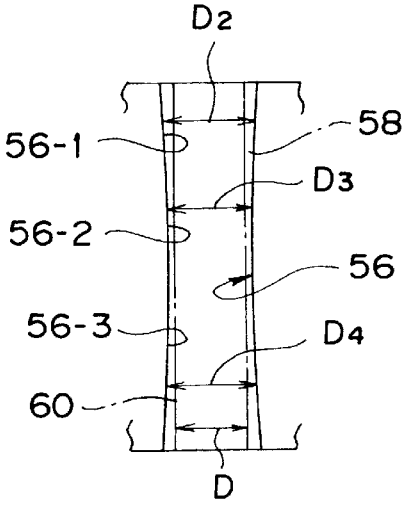
FIG. 2 is an enlarged view of the case-side bolt hole in FIG. 1.

A case-side bolt hole 56 vertically passes through the lower case 8 so as to accommodate the lower-case setting bolt 42, which bolt hole 56 communicates with the first case-side oil channel 54. As shown in FIG. 2, the case-side bolt hole 56 at its upper end is formed with a first case-side hole portion 56-1 having a diameter D2 at its upper side. The hole 56, at its central portion where it communicates with the channel 54, is defined by a second case-side hole portion 56-2 having a diameter D3 which is smaller than the diameter D2. Bolt hole 56 at its lower end defines a third case-side hole portion 56-3 having a diameter D4 adjacent its lower end which is almost equal to the diameter D2 of the upper hole portion 56-1. The diameters D2, D3 and D4, are larger than the diameter D1 of the oil channel 54.

By inserting the lower-case setting bolt 42 into the case-side hole 56 from its lower side, a second case-side oil channel 58 is formed between the outer periphery of the bolt 42 and the inner periphery of the bolt hole 56 at the first and second case-side hole portions 56-1 and 56-2. An annular space 60 is formed between the outer periphery of the bolt 42 and the inner periphery of the bolt hole 56 at the third case side hole portion 56-3 thereof. This channel 58 and space 60 allows foreign matters in the oil to sink due to the gravitational force.

As described above, by varying the cross sectional areas of the first and second case-side oil channels 54 and 58, a filter effect is created by decreasing the flow velocity of the oil flowing into the second case-side oil channel 58 from the first case-side oil channel 54, thereby causing foreign matters contained in the oil to sink or precipitate in the space 60.

A block-side bolt hole 62 is formed at the lower side of the cylinder block 4 in alignment with the case-side bolt hole 56. The block-side bolt hole 62 is formed at its lower portion with a block-side hole portion 62-1 having a uniform diameter D5 over a predetermined length. The upper portion of hole 62 is defined by a block-side hole portion 62-2 which is internally threaded and is aligned with the hole portion 62-1. The threaded hole portion 62-2 is threadably engaged by the upper end of the lower-case setting bolt 42. The diameter D5 of the block-side hole portion 52-1 is almost equal to the diameter D2 of hole portion 56-1. The hole portion 62-1 has a sealing surface between the cylinder block 4 and the lower case 8. However, because the block-side hole portion 62-1 is extended up into the cylinder block 4, the fastening force of the lower-case setting bolt 42 is uniform, the seal formed is good, and the pressure on the sealing surface is uniform because the bearing surface of the lower-case setting bolt 42 and the block-side screw portion 62-2 are separate from the sealing surface.

By inserting the lower-case setting bolt 42 into the block-side bolt hole 62, a first block-side oil channel 64 of, for example, approximately 1 mm is formed between the outer periphery of the lower-case setting bolt 42 and the inner periphery of the block-side bolt hole 62 at the hole portion 62-1. The equation defining the width of the oil channel 64 is $D5/2-D/2\approx 1$ mm. Thus, when foreign matters of 1 mm or more are contained in the oil supplied from the second-case oil channel 58, the foreign matters are prevented from circulating. The second case-side oil channel 58 is formed with dimensions almost the same as that of the first block-side oil channel 64.

Also, as shown in FIG. 1, an oil groove 66 is formed in the cylinder block 4 adjacent the back side of the crank bearing 48 and extends in a circular path from the lower face of the block 4 to the upper side of the block-side crank bearing 48. Furthermore, a second block-side oil channel 68 communicates between the upper end of the first block-side oil channel 64 and the oil groove 66. The second block-side oil channel 68 is formed of a diameter D6 smaller than the diameter D5 of the block-side hole portion 62-1, and communicates approximately with the central portion of the oil groove 66 by pointing diagonally downward from the upper end of the channel 68 generally toward the crankshaft axis. A similar filtering effect is thus generated by the second block-side oil channel 68 and the oil channel 66, and it is possible to cause relatively-small foreign matters contained in the oil to sink via gravitational force to the bottom of the oil groove 66.

An oil passing hole 70 is formed on the block-side crank bearing 48 at the upper end side of the oil groove 66. The oil, free from foreign matters, is supplied to the oil passing hole 70 from the groove 66.

The cross-sectional relation between the diameter D of the lower-case setting bolt 42, diameter D2 of the first case-side hole portion 56-1, diameter D1 of the first case-side oil channel 54, and diameter D6 of the second block-side oil channel 68 is defined by the inequality: $\pi(D2/2)^2-\pi(D/2)^2>\pi(D1/2)^2>\pi(D6/2)^2$.

In FIG. 1, the arrows in the oil channels indicate the direction of lubricating oil and foreign matters flow. The solid arrows indicate the direction of oil flow. The dashed line arrow indicates the direction of movement of relatively large metallic powder and sand particles. The dotted line arrow indicates the direction of movement of relatively small metallic powder and sand particles.

Figure 4:
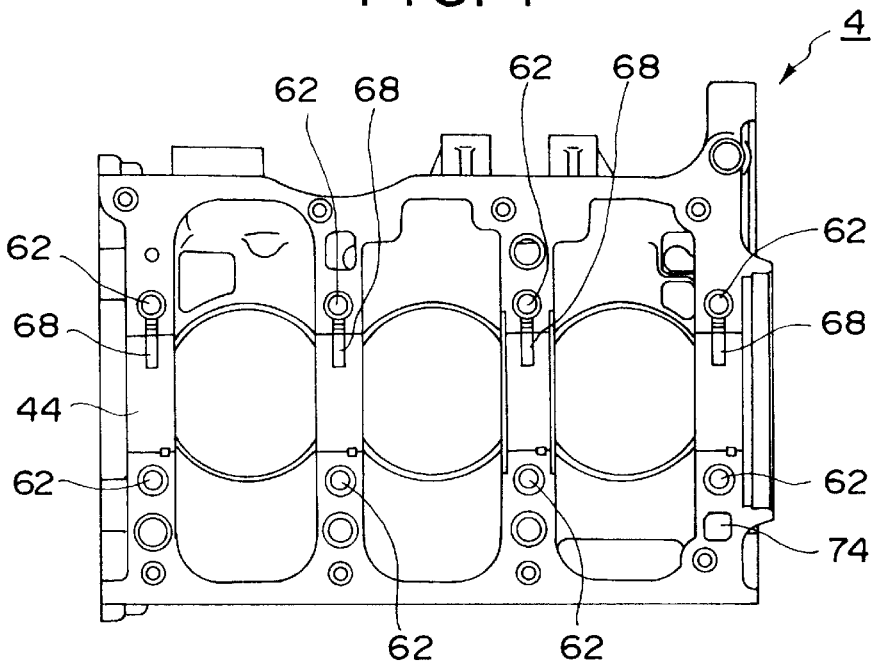
FIG. 4 is a bottom view of a cylinder block.
Figure 5:
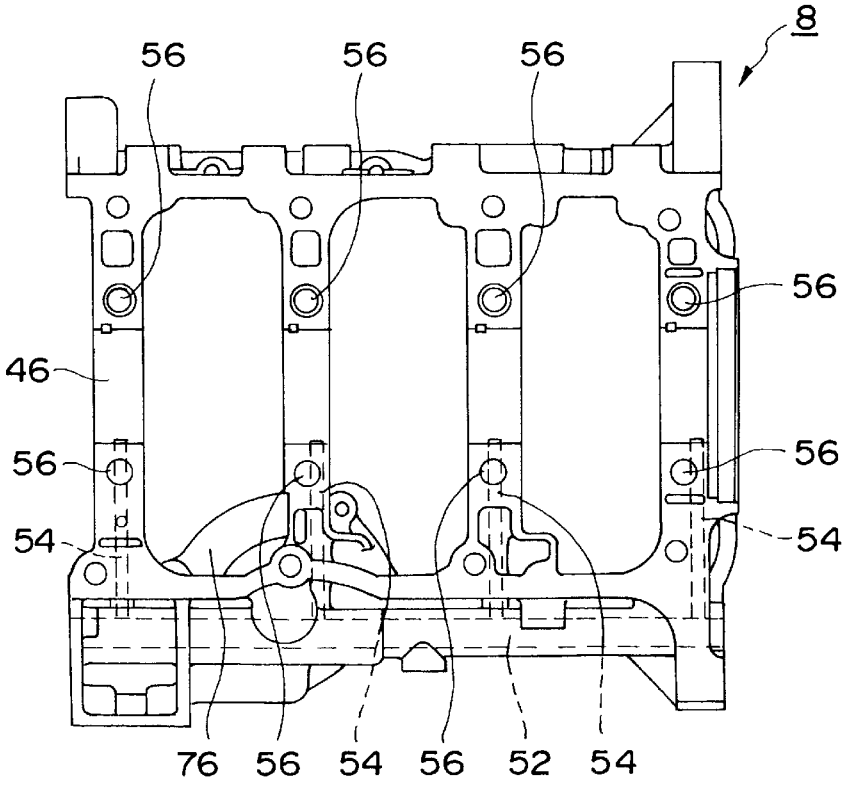
FIG. 5 is a top view of a lower case.

In FIGS. 3 to 5, reference 72 denotes a knock-pin, 74 denotes a blow-by gas channel also serving as an oil dropping channel, and 76 denotes an oil-filter setting portion.

The function of the invention will be described below.

When the oil reaching the first case-side oil channel 54 from the main gallery 52 enters the second case-side oil channel 58, the flow velocity of the oil decreases because the cross sections of the channels differ from one other. Then, because the cross section of the first case-side hole portion 56-1 is different from that of the second case-side hole portion 56-2, and moreover then the size of the gap of the second case-side channel 58 is as narrow as approximately 1 mm, a filter effect occurs and relatively-large foreign matters contained in the oil move downward in the gravitation direction and are collected in the space 60.

Moreover, when the oil in the second case-side oil channel 58 reaches the first block-side oil channel 64, relatively-large foreign matters in the oil not removed by the second case-side oil channel 58 are removed by the first block-side oil channel 64 which also has a small size or gap (e.g. 1 mm). Then, the foreign matters sink due to gravitational force and collect in the space 60.

Furthermore, because the second block-side oil channel 68 communicates with the middle of the oil groove 66, relatively-small foreign matters contained in the oil entering the oil groove 66 collect in the bottom of the oil groove 66, and oil free from foreign matters is supplied to the crank journal 10*a* through the oil passing hole 70.

As a result, a filter effect is generated at the communicating portion between the first case-side oil channel 54 and the second case-side oil channel 58 and the communicating portion between the second case-side oil channel 58, the first block-side oil channel 64, the second block-side oil channel 68, and the oil groove 66. Therefore, it is possible to substantially prevent foreign matters from entering the crank journal 10*a*, and the block-side and case-side crank bearings 48 and 50. This prevents damage and seizing from occurring. Moreover, it is possible to easily form the oil groove 66 in the cylinder block 4.

The present invention allows removal of the foreign matters by decreasing the flow velocity of oil at the communicating portion between the first case-side oil channel 54 and the second case-side oil channel 58, and thereby allowing the foreign matters contained in the oil to flow downwardly by gravity. The decreased flow velocity of the oil allows the foreign matter to settle by gravitational force.

The present invention makes it possible to prevent foreign matters contained in lubricating oil from flowing into the crank journal. The invention prevents damage and seizing from occurring to the crank bearings by forming an oil channel between the outer periphery of a lower-case setting bolt and the inner peripheries of a case-side bolt hole and a block-side bolt hole so as to prevent the flow of foreign matters contained in the lubricating oil flowing from a main gallery toward the crank journal. The oil channel has a cross section that varies between the main gallery and the crank journal so as to decrease the flow velocity of the lubricating oil flowing from the main gallery toward the crank journal.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A lubricating-oil channel structure of an engine, comprising a cylinder block of the engine, a block-side bolt hole formed in said cylinder block, a lower case fixed to said cylinder block, a case-side bolt hole formed in said lower case in alignment with the block-side bolt hole, a lower-case setting bolt inserted into said case-side bolt hole to fix said lower case to said cylinder block and screwed into said block-side bolt hole, a crank journal of a crankshaft journaled between said cylinder block and said lower case through a crank bearing, a main gallery formed in said lower case to circulate lubricating oil, and an oil channel arrangement for leading the lubricating oil supplied from said main gallery to said crank journal, wherein the oil channel arrangement includes an oil channel formed between an outer periphery of said lower-case setting bolt and at least one of inner peripheries of said case-side bolt hole and said block-side bolt hole so as to prevent the flow of foreign matters contained in the lubricating oil flowing to said crank journal from said main gallery.

2. A lubricating-oil channel structure of an engine, comprising a cylinder block of the engine, a block-side bolt hole formed in said cylinder block of said engine, a lower case fixed to said cylinder block, a case-side bolt hole formed in said lower case, a lowercase setting bolt inserted into said case-side bolt hole to fix said lower case to said cylinder block and screwed to said block-side bolt hole, a crank journal of a crankshaft journaled between said cylinder block and said lower case through a crank bearing, a main gallery formed in said lower case to circulate lubricating oil, and an oil channel arrangement for leading said lubricating oil from said main gallery to said crank journal, said oil channel arrangement includes an oil channel whose cross sectional area varies so as to decrease the flow velocity of the lubricating oil flowing from said main gallery to said crank journal, said oil channel being formed between said main gallery and said crank journal.

3. The lubricating-oil channel structure of an engine according to claim 2, wherein said oil channel has a space in which the foreign matter settles due to gravitational force, said space located at the bottom of said oil channel.

4. A lubricating oil channel structure of an engine comprising:

a cylinder block having a block-side bolt hole;

a lower case fixed to said cylinder block and having a case-side bolt hole;

a lower case setting bolt passing through said lower case-side bolt hole and screwed into said block-side bolt hole so as to fix said lower case to said cylinder block;

a crank journal bearing arrangement for a journal of a crankshaft formed between said cylinder block and said lower case, said crank journal bearing arrangement having crank bearings mounted on said cylinder block and said lower case;

a main gallery formed in said lower case to circulate lubricating oil;

a first oil channel formed in said lower case and connected to said main gallery for conducting the lubricating oil;

a second oil channel formed between the outer periphery of said lower case setting bolt and the inner peripheries of said case-side bolt hole and said block-side bolt hole, said second oil channel connected between said first oil channel and said crank journal such that the flow of foreign matter contained in the lubricating oil is prevented from flowing to said crank journal.

5. A lubricating oil channel structure of an engine according to claim 4, wherein said second oil channel has a cross sectional diameter that increases in an upward oil flow direction along a length thereof such that the flow velocity of the lubricating oil is decreased.

6. A lubricating oil channel structure of an engine according to claim 5, wherein the decreased flow velocity of the lubricating oil allows the foreign matter to settle due to gravitational force.

7. A lubricating oil channel structure of an engine according to claim 6, wherein said second oil channel has a space formed at a bottom thereof for collecting foreign matter which has settled from the upward flowing oil due to gravitational force.

8. A lubricating oil channel structure of an engine according to claim 4, including an oil groove located adjacent an upper part of said crank bearing and a third block-side oil channel connected between said second oil channel and said oil groove, said third block-side oil channel and said oil groove oil conducting oil from said second oil channel to said crank journal bearing arrangement.

9. A lubricating oil channel structure of an engine according to claim 8, wherein said oil groove causes the flow velocity of the lubricating oil to decrease and the foreign matter to settle due to gravitational force such that the foreign matter is prevented from flowing to said crank journal bearing arrangement.

10. A lubricating oil channel structure of an engine according to claim 4, wherein said second oil channel has a first block-side oil channel part and a second case-side oil channel part which coaxially communicate to form said second oil channel.

* * * * *